United States Patent [19]

Siddoway et al.

[11] Patent Number: 4,797,136

[45] Date of Patent: Jan. 10, 1989

[54] LOW RANK COAL BY WET OXIDIZING, DRYING AND COOLING

[75] Inventors: Mark A. Siddoway, Houston; Neal D. Stidham, Gillette, Wyo.; William C. Machmer, Sugarland, Tex.

[73] Assignee: Shell Oil Company, Houston, Tex.

[21] Appl. No.: 175,653

[22] Filed: Mar. 15, 1988

Related U.S. Application Data

[63] Continuation of Ser. No. 943,455, Dec. 19, 1986, abandoned.

[51] Int. Cl.[4] ..... C10L 5/24; F26B 7/00

[52] U.S. Cl. ..... 44/501; 34/13

[58] Field of Search ..... 44/501, 620; 34/13, 34/20

[56] References Cited

U.S. PATENT DOCUMENTS

| | | | |
|---|---|---|---|
| 1,781,102 | 11/1930 | Collins, Jr. | 44/1 R |
| 2,338,634 | 1/1944 | Fuchs | 44/1 R |
| 4,043,763 | 8/1977 | Norman et al. | 44/1 G |
| 4,396,394 | 8/1983 | Li et al. | 44/1 R |
| 4,402,706 | 9/1983 | Wunderlich | 44/501 |
| 4,501,551 | 2/1985 | Riess et al. | 44/501 |

*Primary Examiner*—Carl F. Dees

[57] ABSTRACT

The spontaneous ignition of low rank coal is inhibited by spraying coal with an aqueous solution of an oxidizing agent which contains combined oxygen, drying oxidizing agent-sprayed coal and cooling the dried coal.

11 Claims, 1 Drawing Sheet

LOW RANK COAL BY WET OXIDIZING, DRYING AND COOLING

This is a continuation of application Ser. No. 943,455, filed 12/19/86, abandoned.

BACKGROUND OF THE INVENTION

The present invention relates to inhibiting the spontaneous ignition of low rank coals. More particularly, the invention relates to improving a treatment in which the coal is dried while being oxidized and cooled in order to increase its stability.

Numerous treatments have been designed for oxidizing coal to reduce its content of sulphur and ash. For example, U.S. Pat. No. 3,909,211 describes heating coal at 100°–500° F. with gas inclusive of $NO_2$. U.S. Pat. No. 4,022,588 describes reacting the coal with specified metal oxides then washing or extracting the treated coal. U.S. Pat. Nos. 4,097,244 and 4,015,416 describes treating the coal with an aqueous solution containing an iron complexing agent and a metal oxidant and reacting the so-treated coal with a hydrogen donor. U.S. Pat. No. 4,183,730 describes reacting coal with an aqueous solution of hydrogen peroxide and sodium chloride, then washing the treated coal. U.S. Pat. No. 4,256,464 describes contacting the coal with a liquid organic solvent for nitrogen oxides, then reacting it with gas containing oxygen and nitric oxide. U.S. Pat. No. 4,328,002 describes treating coal with an aqueous oxidizing agent, washing it, reacting it with oxygen to an extent causing an exothermic temperature peak, then washing and drying the treated coal.

Oxidative processes have also been proposed to reduce the molecular weight of the coal and/or render parts of the coal soluble in organic solvents. U.S. Pat. Nos. 2,242,822 and 2,338,634 relate to oxidizing coal, first with air, then with nitric acid, in order to generate hydroxycarboxylic acid groups that cause the non-fusain organic materials to become soluble in organic solvents containing heterocyclic oxygen, with ammonium nitrate or other oxides being used as catalysts in the oxidizing step.

Somewhat milder oxidative processes have been described for inhibiting the spontaneous ignition of low rank coals. For example, U.S. Pat. No. 3,723,079 describes treating coal which has been dried to about 1–10 percent moisture content by means of an air oxidation that provides an oxygen uptake of about 0.5 to 8 percent then rehydrating the coal. U.S. Pat. Nos. 4,396,394 and 4,401,436 describe sequentially drying the coal to near the moisture content desired for the product, oxidizing it by an upflow of hot oxygen-containing gas, then cooling the treated coal to less than about 100° F., or doing the cooling while adding water in order to increase the rate of cooling by the water evaporation.

SUMMARY OF THE INVENTION

The present invention relates to an improvement in a process in which low rank coal is dried, oxidized and cooled in order to reduce the tendency for spontaneous combustion. In the present process, the particulate coal is first sprayed with an aqueous oxidant solution to distribute the solution substantially homogeneously over the surfaces of the coal particles without adding more than about 10% by weight of water. The amount of water added is preferably less than 2% by weight of water based on the weight of the coal. The sprayed-on solution contains a relatively high concentration solution of a relatively mild water-soluble oxidizing agent containing combined oxygen. The oxidant-wetted coal is dried by heating it to reduce its water content to substantially that desired for the coal product. The heating temperature is controlled so that the coal particle temperatures remain less than about 400° F., with less than 300° F. being preferred and less than 250° F. being especially preferred. The dried coal is then cooled to a temperature of less than about 100° F.

In preferred embodiments the coal is screened into relatively coarse and relatively fine fractions. The aqueous oxidant solution containing an oxidizing agent is then separately applied to the coarser and finer fractions. The oxidant-sprayed finer fraction is dried and recombined with the coarser fraction. In a particularly preferred embodiment, the hot, oxidant-sprayed, dried fines are blended with the coarse oxidant-sprayed coarser fraction and the blended fractions are cooled.

DESCRIPTION OF THE INVENTION

Figure 1:
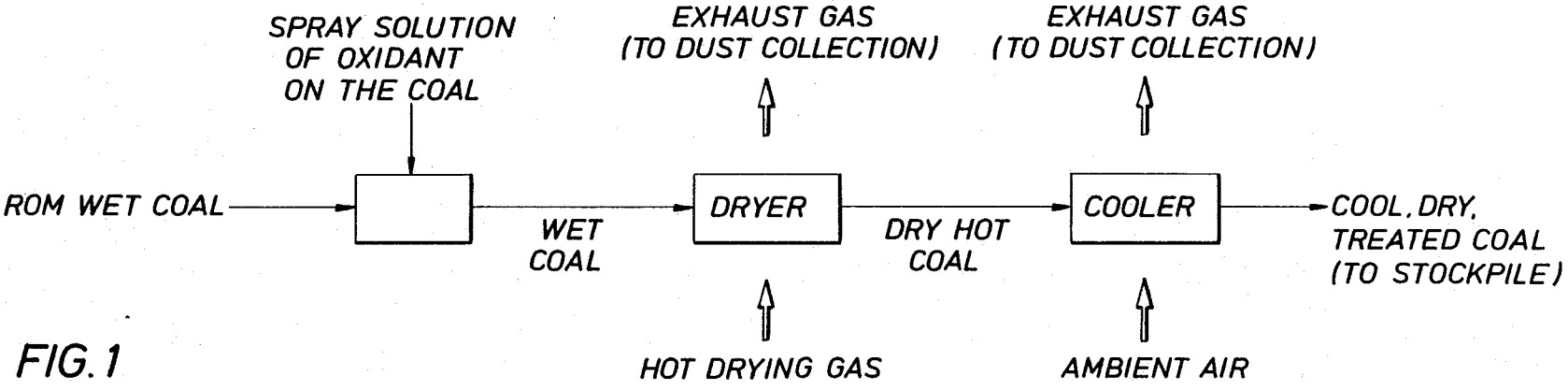
FIG. 1 is a flow sheet for processing dried low rank coal with all of the coal being dried.

There are several known methods for inhibiting spontaneous iginition of low rank coal. These methods may either limit oxygen contact with the coal particle surfaces or oxidize the coal to lower its oxidative reactivity. Methods of limiting oxygen contact with the coal include compaction to decrease air penetration into a pile of coal and/or coating the coal with a substance for limiting oxygen access to surfaces of the coal. Several currently used methods of oxidizing coal expose the coal particles to molecular oxygen. The stabilization provided by such an exposure is based on the decrease in the rate of the oxidation reaction as the coal is oxidized.

In the present process the coal is oxidized by contacting it with an aqueous oxidant solution of an oxidizing agent in which the oxygen exists in combined form, as opposed to molecular oxygen. In general, the oxidizing agent can be substantially any relatively mild, relatively water-soluble oxygen-containing oxidizing agent. The oxidizing agent is preferably present in the aqueous solution in a relatively high concentration, preferably a concentration which substantially saturates the solution. Particularly suitable oxidizing agents include perchlorates, chlorates, peroxides, hypochlorites, or nitrates in which the cations comprise metal, hydrogen or ammonium ions. Such a means of contacting the coal with an aqueous oxidant allows the surfaces of the coal to be substantially uniformly contacted; without a need for special equipment such as oxidizing vessels, or the like, or the need for increasing the moisture content of the contacted coal by more than about 2% by weight of the coal.

In a preferred embodiment the oxidant solution is sprayed onto the coal at a drop point, or on a belt, and is nearly saturated, to an extent minimizing the amount of water without causing precipitation of the oxidizer. Where desired, the oxidant solution can be heated and can be applied with a conventional spraying or atomizing nozzle.

The present method of applying the oxidant contacts the coal with an aqueous oxidant solution before the coal is dried. This enables the water-soluble oxidizer to diffuse into the water in and on surfaces of the coal and to penetrate beyond the peripheral surfaces of the coal. This application, prior to the heating and evaporation which occurs in the drier, causes the oxidation reaction to be accelerated at the elevated temperature of the drier and the concentrating of the oxidizing chemical due to the evaporation of water. Where desired, for example, in using a relatively low coat and/or relatively unreactive oxidizer, a supplemental addition of the oxidant solution can be made to the coal after it leaves the drier and before it enters a cooler.

LABORATORY TEST (MAGNESIUM PERCHLORATE)

For these experiments a sample of Western sub-bituminous coal was riffled into two 1000 gm homologous aliquots. The coal was from the Southern Powder River Basin in Wyoming. An untreated control sample was created by slurrying one aliquot with 1000 milliliters distilled water. A treated coal sample was created by slurrying the other homologous aliquot with a solution of 10 gms magnesium perchlorate per 1000 milliliters of distilled water to an extent providing 1.4% by weight of magnesium perchlorate based on the weight of the dried coal. The treated and untreated samples were dried in a nitrogen-purged vacuum oven at 105°-110° C. for 48 hours. The dried coal samples were placed in isothermal reactors through which a steady current of air was passed, and the oxygen consumption was measured as a function of time.

The initial oxygen consumption rate of the treated sample was only about 50 percent of that of the untreated sample. The change in the natural logirithm of the oxidation rate with cumulative oxidation (or the integral of the amount of prior oxidation) indicates that the oxidzer has an affect which is roughly similar to molecular oxygen in that the initial rate of oxidation is diminished; which indicates that the present utilization of an oxidant which contains combined oxygen, rather than molecular oxygen, causes a preoxidation of the coal which prevents, or at least delays, subsequent spontaneous ignition—and does this in a way that is more easily accomplished than it could be done with molecular oxygen. In addition, since a solution of water-soluble oxidizer is sprayed onto the surface of the coal the oxidizer is free to migrate through the coal's original moisture into contact with the coal's surface in and around fine interstices and fine pores.

The effectiveness of the water-soluble oxidizer dissolved in a slurry of the coal indicates a capability of the present process for treating coal in a coal/water slurry being pipelined, and thus mitigating the storing and handling problems on the receiving end of the pipeline.

LABORATORY TEST (AMMONIUM NITRATE)

Treated coal was prepared by slurrying about 1000 gms of wet, as-received sub-bituminous coal in solutions of ammonium nitrate in 1000 milliliters distilled water. An untreated control sample was prepared by slurrying about 1000 gms of homologous wet coal in 1000 milliliters pure distilled water. The samples were then dried in nitrogen-purged vacuum ovens at 100°-105° C. for 48 hours. The isothermal uptake of oxygen with time was monitored for th esamples. The ammonium nitrate decreases the rate at which the dried coal absorbed oxygen. Significant decreased were observed when concentrations of the ammonium nitrate were 0.7 and 1.4% by weight based on the weight of the dried coal.

PREFERRED PROCEDURE

FIG. 1 shows a preferred procedure for processing low rank coal where all of the coal is to be dried. The functioning of a spraying procedure is substantially analogous to the slurrying procedures of the laboratory tests described above.

Figure 2:
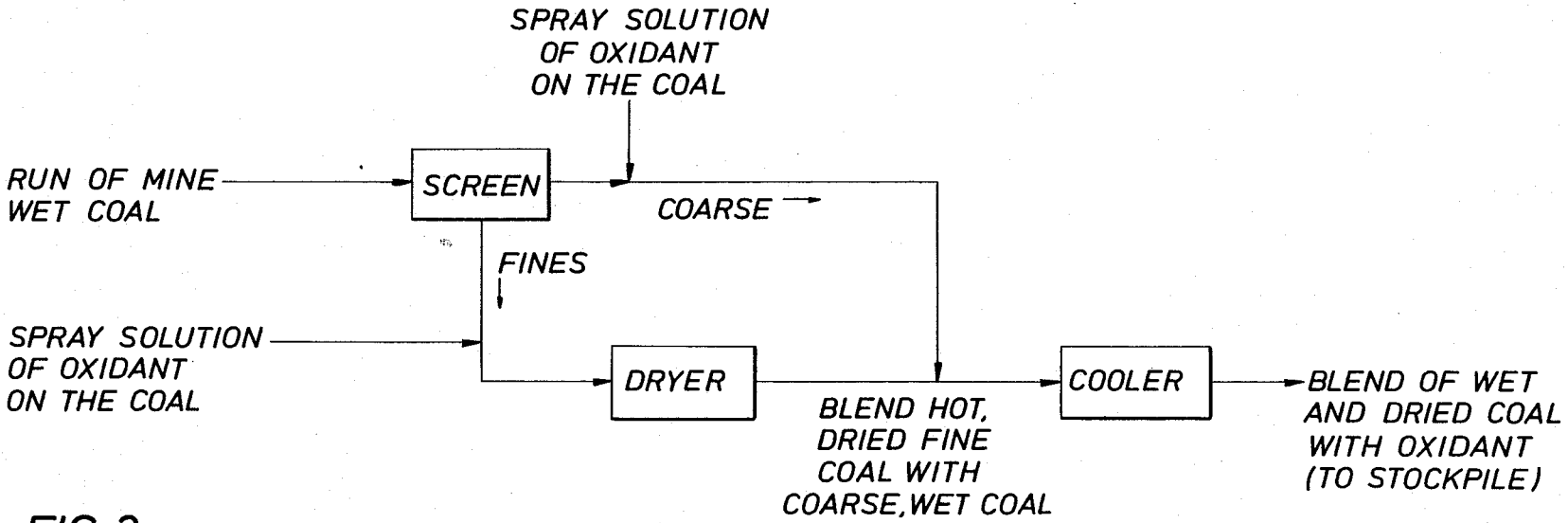
FIG. 2 is a flow sheet for a preferred processing of the coal.

FIG. 2 shows the particularly preferred procedure for screening run-of-the-mill coal to relatively coarse and fine fractions, separately spraying each fraction with an aqueous oxidant solution, drying the treated fines fraction and recombining the treated fractions. This procedure was tested at a mine site in the Powder River Basin.

The procedure used in the Powder River test deviated from that shown in FIG. 2 in that the treated fines fraction was cooled before it was mixed with the treated coarse fraction. In the Powder River field test, run-of-the-mine 2"×0 coal was fed onto a ¾ inch mesh screen. The fines fraction which passed through the screens was dried but the coarse fraction, which flowed over the screen was not dried. An ammonium nitate solution containing 25-33% by weight of ammonium nitrate in water was sprayed on after the screening to both the coarse and fine fraction. In the Powder River test, the dried fines and the wet coarse fraction were blended after cooling the dried fines. The fine coal particles were heated from ambient temperature to 150°-250° F. in 2-10 minutes and the cooler reduced the temperature of the fine dried coal particles by 50°-100° F.

The amounts of the oxidant solution applied to the fines and coarse fractions were kept the same for both fractions. 50 tons of coal were treated with less than 0.2% by weight ammonium nitrate and 50 tons of the coal was treated with less than 0.5% by weight ammonium nitrate. The 50-ton treated samples were stockpiled next to each other in a specially prepared berm area to make a 100-ton stockpile. The stockpile began smoldering after 33 days. A control untreated pile which was dried by means of the same process and conditions, except for not being sprayed with the ammonium nitrate solution, began smoldering after being stockpiled for only 8 days.

Smolders were manifest by ash layers on the surface of the pile and smoke. The temperatures of each of the piles were monitored with 20 thermocouples per pile. After 3 days of storage the maximum measured temperature reached in the control pile was 190° F. After 25 days storage the maximum measured temperature reached in the pile treated with ammonium nitrate was about 160° F.

It is apparent that the ammonium nitrate treatment has been shown in the laboratory and field tests to significantly inhibit the spontaneous ignition tendency of dried low rank coal. As known in the art, ammonium nitrate is an inexpensive, non-toxic, and relatively available chemical.

The processing scheme shown in FIG. 2 in which the oxidant wetted coarse fraction of coal is blended with the oxidant wetted and dried fines fraction of coal prior to the cooling of the mixture, is especially preferred. With about the same amount of treating time and expense, the process of FIG. 2 (where the coal is blended prior to being cooled) will tend to produce a cooler product. A product which is stockpiled at a lower temperature will have a lower spontaneous ignition tendency than one which is initially hotter.

In general, the water used to form the aqueous solution of oxidant can be substantially any which is a good solvent, is miscible with the particular oxidizer to be used and is substantially inert to the coal oxidation reaction. Particularly suitable waters have a total dissolved solids content of no more than about 10 grams per liter and contents of major cations (i.e., those present in more than trace amounts) of no more than about 150 meq. per liter.

In general, the procedures and devices such as coal transfer devices, screens, driers, coolers, and the like, can be substantially any of those currently available which are suitable for their intended functions.

What is claimed is:

1. In a process in which low rank coal is oxidized, dried and cooled for reducing its tendency toward spontaneous combustion, an improvement comprising:

contacting particulate coal with an aqueous oxidant solution which becomes substantially homogeneously distributed over the surfaces of the coal particles, without adding more than about 10% by weight of water to the coal;

said solution containing an oxidizing agent containing combined oxygen;

drying the oxidant solution wetted coal by heating the coal particles to a temperature between about 100° F. and about 400° F. to reduce the moisture content to substantially the moisture content desired for the coal product; and cooling the so-treated coal to a temperature of less than about 100° F.

2. The process of claim 1 in which the coal is separated into relatively coarse and fine fractions, the aqueous oxidant solution is applied to both fractions, the oxidant-containing fines fraction is dried, and the so-treated fractions are mixed.

3. The process of claim 2 in which the oxidant-containing coarse fraction is mixed with the oxidant-containing dried fines fraction before the so-treated fractions are cooled.

4. The process of claim 1 in which the coal is separated into relatively coarse and fine fractions, the aqueous oxidant solution is applied to the fine fraction, the oxidant-containing fines fraction is dried, and the fractions are mixed.

5. The process of claim 1 in which the oxygen-containing oxidizing agent is a member selected from the group consisting of perchlorates, chlorates, peroxides, hypochlorites, and nitrates.

6. The process of claim 1 in which the oxygen-containing oxidizing agent is ammonium perchlorate.

7. The process of claim 1 in which the oxygen-containing oxidizing agent is ammonium nitrate.

8. The process of claim 1 in which the coal is heated to a temperature between about 100° F. and about 300° F.

9. The process of claim 1 in which the coal is heated to a temperature between about 150° F. and about 250° F.

10. The process of claim 1 in which the coal is heated to a temperature between about 100° F. and about 150° F.

11. The process of claim 1 in which the water added by the aqueous oxidant solution is not more than about 2% by weight.

* * * * *